United States Patent [19]

Iijima et al.

[11] Patent Number: 4,773,941

[45] Date of Patent: Sep. 27, 1988

[54] METHOD AND DEVICE FOR WASHING POROUS WORKPIECES IN AN IMPREGNATION PROCESS

[75] Inventors: Kunio Iijima, Tokorozawa; Hiromitsu Suganuma, Urawa; Makoto Otsubo, Sayama, all of Japan

[73] Assignee: Honda Giken Kogyo Kabushiki Kaisha, Tokyo, Japan

[21] Appl. No.: 843,357

[22] Filed: Mar. 24, 1986

[30] Foreign Application Priority Data

Dec. 2, 1985 [JP] Japan ..... 60-270908

[51] Int. Cl.[4] ..... C23C 13/08

[52] U.S. Cl. ..... 134/33; 134/25.1; 134/25.4; 427/294; 427/295; 427/353

[58] Field of Search ..... 134/25.1, 25.4, 33; 427/294, 295, 353

[56] References Cited

U.S. PATENT DOCUMENTS 4,209,342 6/1980 Workman ..... 134/33
4,314,856 2/1982 Steinel ..... 134/33

FOREIGN PATENT DOCUMENTS 2326326 5/1973 Fed. Rep. of Germany ..... 134/33

*Primary Examiner*—Asok Pal
*Attorney, Agent, or Firm*—Armstrong, Nikaido, Marmelstein & Kubovcik

[57] ABSTRACT

A method for washing an impregnated porous workpiece including a step of rotating the impregnated porous workpiece after excessive impregnant has been shaken off, in such a manner that the workpiece is immersed in and comes out of a washing liquid contained in a washing tank, forcibly causing the washing liquid to go in and out of a recessed portion such as a hole bored in the workpiece to thereby dilute and wash away residual impregnant adhering to the inside of the recessed portion.

5 Claims, 5 Drawing Sheets

FIG. 5a
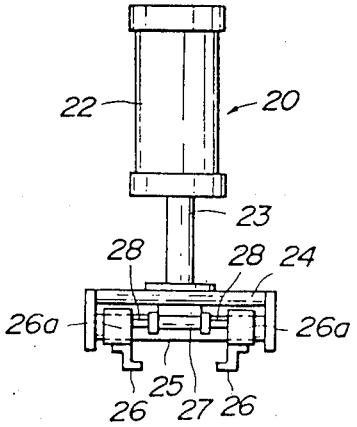
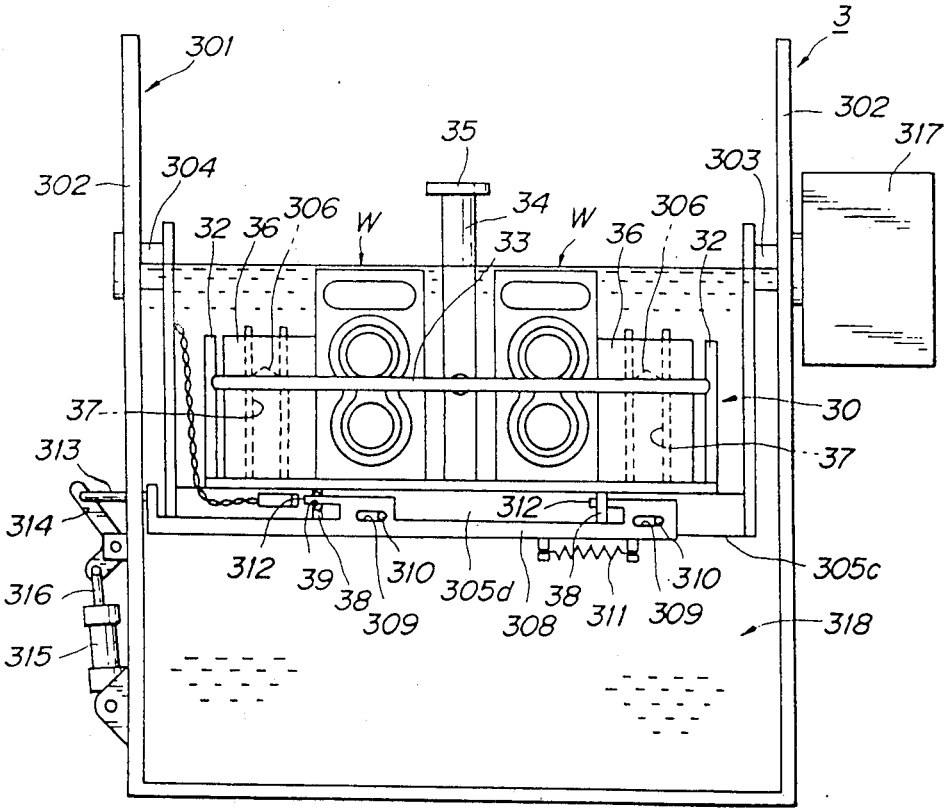
FIG. 5b 3
301
318
303
305
305b
W
W1
W2
W3
W4
W5
W6

METHOD AND DEVICE FOR WASHING POROUS WORKPIECES IN AN IMPREGNATION PROCESS

BACKGROUND OF THE INVENTION

1. Field of the Invention

The present invention generally relates to a method and a device for washing a porous workpiece during an impregnation process thereof. More particularly, the invention relates to a method for washing a porous workpiece such as a cast or sintered article in an impregnation process thereof in order to fill up the pores, such as blowholes or pinholes in the workpiece, with an organic impregnant, as well as a device for performing same.

2. Description of Relevant Art

There are known, such as by Japanese Patent Application Laid-Open Publication No. 59-28503, systems which include in a process for filling in blowholes or pinholes in a porous workiece such as a cast or sintered article, a step of dipping the article in an organic impregnant to thereby impregnate the blowholes, pinholes, or the like with the impregnant. In such impregnation systems, the impregnation step has been placed as a final step in the workpiece machining line for the purpose of labor-saving and the elevation of productivity. It is desirable to automate the impregnation process in accordance with production line tactics of management.

In general, after being impregnated, the workpieces must be washed to remove excessive impregnant from their surfaces. Such a washing step is an important process that is needed to produce finished goods, and particularly affects the appearance, precision of machining, etc. of the product.

In such a washing process, it generally is difficult to remove impregnant that remains in blind holes such as drill holes or tap holes bored in the workpiece. The workpieces contained in a basket were moved up and down in the washing liquid to remove excessive impregnant adhering to the outer surfaces of the workpieces. Conventionally, a worker was required to blow air into each of the blind holes in the workpieces to thereby remove excessive impregnant still remaining in the hole. As a result, the step of washing was intricate and troublesome, as well as being inefficient. Improvement was desired to increase production efficiency.

Further, automatic devices for washing impregnated workpieces have already been tried including one that was adapted to cause violent streams during washing in the washing liquid itself, and also another which used a shower of hot water as disclosed in U.S. Pat. No. 4,384,014 by Young, patented on May 17, 1983. In either example, however, little effect is expectable unless the water streams hit the blind holes in the workpiece. In the case of simultaneously processing many workpieces, it was especially difficult to remove impregnant by washing because some of the workpieces shield parts of the remaining workpieces.

The present invention has been achieved to effectively solve such problems in conventional washing processes of impregnated porous workpieces.

SUMMARY OF THE INVENTION

Accordingly, an object of the present invention is to provide a method and a device for washing porous workpieces in an impregnation process, which assure effective washing even at narrow and severely concave or convex portions such as blind holes or tap holes in the workpieces, as they are impregnated, and permit the same to be performed in an automated manner, thereby raising production efficiency of the impregnation process including a washing step.

To achieve such object, the present invention provides a method for washing an impregnated porous workpiece, comprising setting the impregnated porous workpiece, after excessive impregnant thereon has been shaken off, in a washing tank containing a washing liquid, and rotating the workpiece in such a manner that the workpiece is immersed in and comes out of the washing liquid, forcibly causing the washing liquid to go in and out of a recessed portion such as a hole bored in the work to thereby dilute and wash away residual impregnant adhering to the inside of the recessed portion.

Further, the present invention provides a device for washing an impregnated porous workpiece, comprising a washing tank containing a washing liquid, a means for setting the impregnated porous workpiece at a predetermined position in the washing tank, and a rotation drive means for rotating the workpiece in such a manner that the work is immersed in and comes out of the washing liquid, forcibly causing the washing liquid to go in and out of a recessed portion such as a hole bored in the workpiece to thereby dilute and wash away residual impregnant adhering to the inside of the recessed portion.

BRIEF DESCRIPTION OF THE DRAWINGS

The above and further features, objects and advantages of the present invention will become more readily apparent from the following detailed description of a preferred embodiment of the invention when the same is read in conjunction with the accompanying drawings, wherein:

FIG. 5 is a view similar to FIG. 4, showing a state in which workpieces are set in the washing device.

DETAILED DESCRIPTION OF THE PREFERRED EMBODIMENT

Figure 1:
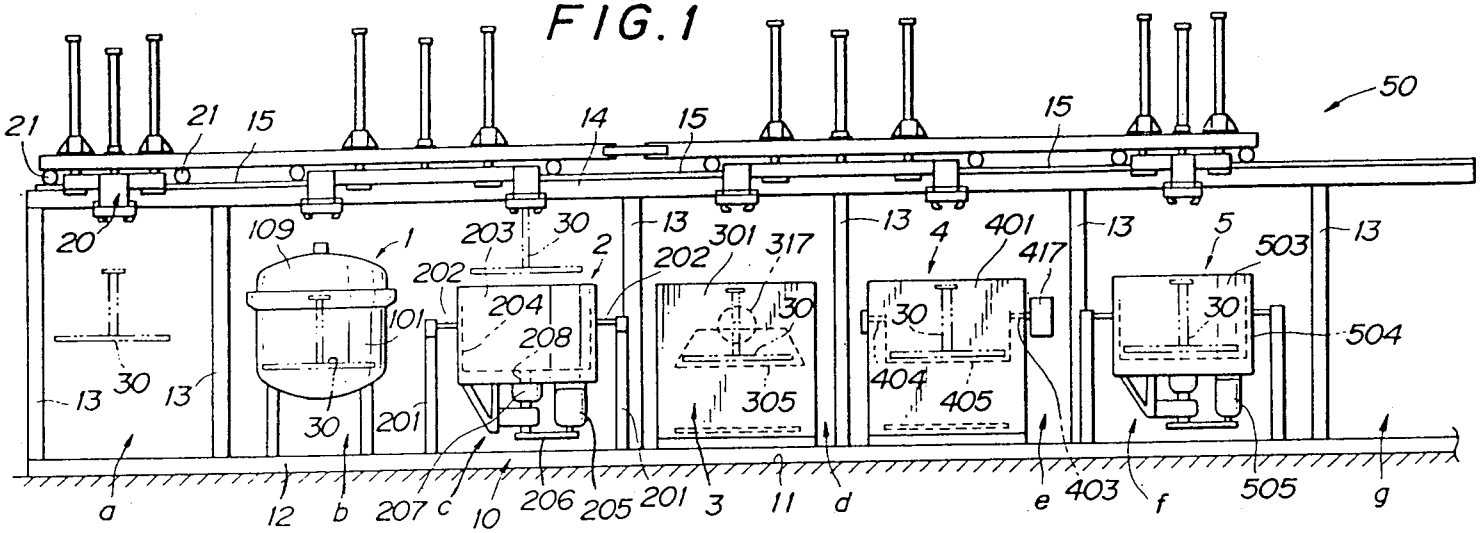
FIGS. 1 and 2 are a side view and a schematic plan view, respectively, of an impregnation system including devices for washing impregnated porous works, according to a preferred embodiment of the present invention.
Figure 2:
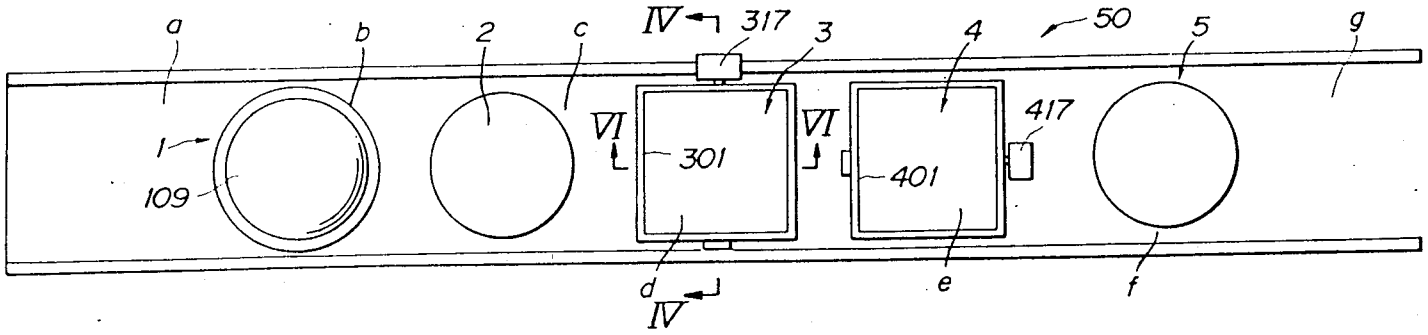

Referring first to FIGS. 1 and 2, a complete impregnation system 50 is shown including a pair of washing devices 3, 4 for washing impregnated porous workpieces (hereinafter collectively designated by reference character W), according to a preferred embodiment of the present invention. FIGS. 1 and 2 are a side view and a schematic plan view of the system 50, respectively.

Incidentally, in the following description, the rightward and the leftward directions of FIG. 1 shall be the frontward and the rearward directions of the system 50, respectively; the upward and the downward directions of the former, those of the latter, respectively; and the upward and the downward directions of FIG. 2, the rightward and the leftward directions of the system 50, respectively.

The impregnation system 50 has a fixed basic frame 10 as a framework of the entire system. The basic frame 10 is constituted with bottom sole plates 12 placed on fixed sills 11, gate-form studs 13 longitudinally (in the front-rear direction) spaced apart from each other, longitudinally extending top headers 14 on the studs 13, at the left and right thereof, and work transfer rails 15 laid on the headers 14, in parallel therewith. On the rails 15 is mounted a transfer device 20 adapted to be movable by means of rollers 21.

The transfer device 20 comprises a holding mechanism and a positioning mechanism for holding and positioning workpiece-holding pallets 30, respectively, as will be later-detailed with reference to FIGS. 4, 5. More particularly, referring to FIGS. 4, 5, the transfer device 20 has suspended from the rails 15 a lifting cylinder 22 provided with a slide rod 23. The slide rod 23 has fixed to the lower end thereof a bracket 24 of a reversed channel-like form in front view, the bracket 24 being provided with a transversely (to the left and right) directed guide bar 25 on which a pair of catches 26, 26 are slidably fitted at their base parts 26*a*, 26*a* in a transversely opposing manner. Between the base parts 26*a*, 26*a* is interposed a cylinder 27 with a pair of transversely projecting rods 28, 28 at both sides thereof. The rods 28, 28 are fastened to the base parts 26*a*, 26*a* of the catches 26, 26 respectively.

The transfer device 20, coming back to FIG. 1, is adapted to travel with the rollers 21, being guided by the rails 5, and is used, for example at a workpiece charging station a of FIG. 1 as follows. The rod 23, as shown in FIGS. 4, 5, is extended downwardly to a predetermined position by operating the cylinder 22. The catches 26, 26 are moved toward each other by operation of the cylinder 27 to thereby clampingly engage a portion of a workpiece-holding pallet 30. The pallet 30 is lifted by upwardly retracting the rod 23, whereupon the pallet 30 can then be sequentially transferred to stations b, c, d, e, f, and g for subsequent process steps, where it is to be set in respective working positions, as required by the process.

In FIG. 1, shown at the left end is the station a which is a process position for charging workpieces W to the system. In this exemplary embodiment, each workpiece W shall be shown as a cylinder block which is a cast piece of an aluminum alloy having holes such as tap holes and blind holes machined in unshown antecedent processes. At the station a, workpieces W are fixedly held on the pallet 30.

Figure 4:
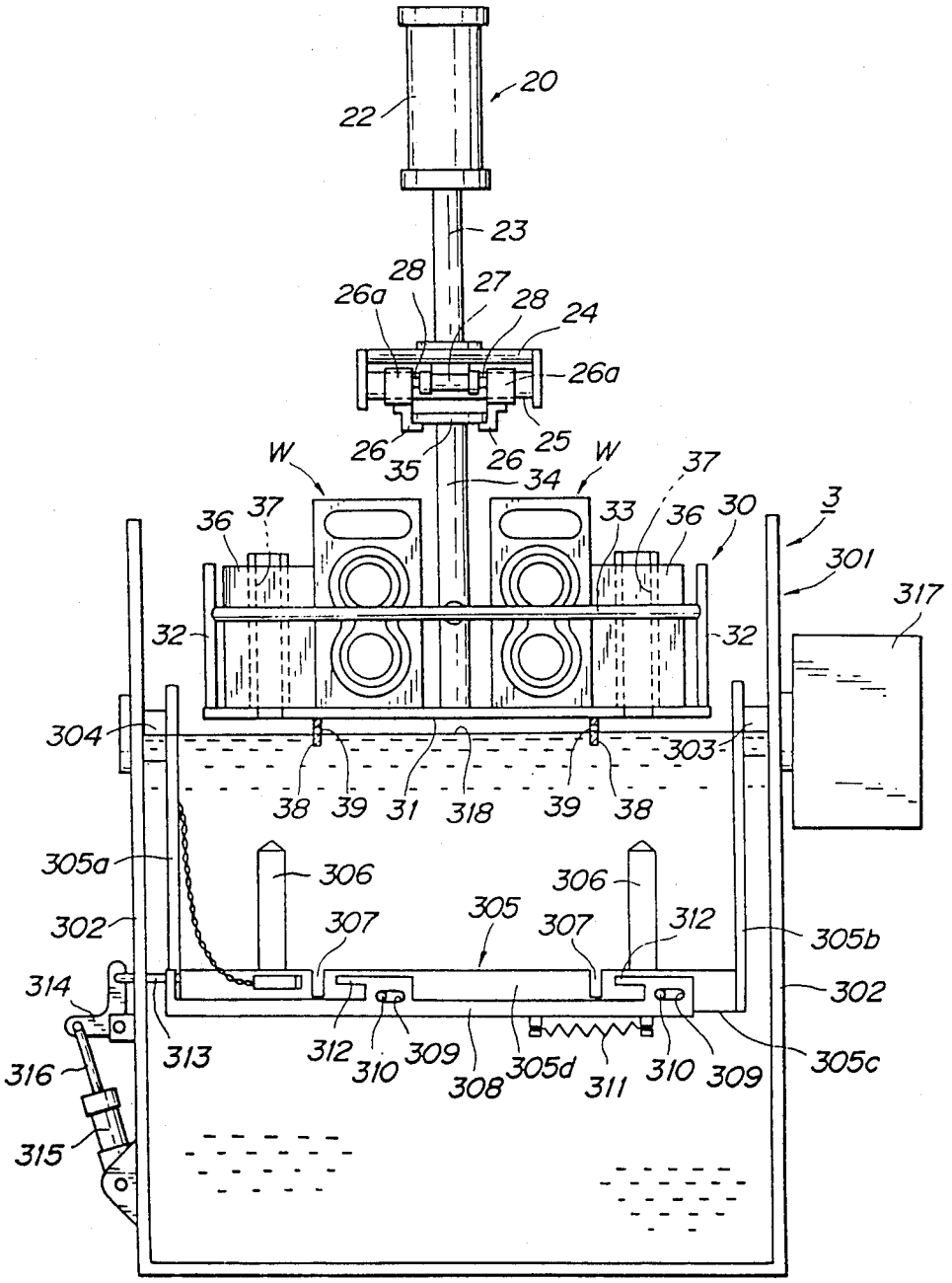
FIG. 4 is a sectional view along line IV—IV of FIG. 2, as a cross-sectional front view of one of the washing devices of the impregnation system of FIG. 1, showing a state before workpieces are set in that device.

The pallet 30 has the structure shown in FIGS. 4, 5, and comprises a substantially rectangular base plate 31 horizontally shown in those Figures, columns 32 standing at the four corners of the base plate 31, beams 33 interconnecting the columns 32 with each other, and a hanging post 34 erected at the center of the base plate 31. The post 34 has an engagement part 35 formed at the top thereof. In this embodiment, the pallet 30 is adapted to support two workpieces W. At both sides of the pallet 30 are provided a pair of jigs 36, 36 with vertical positioning holes 37, 37 formed therethrough, respectively. On the underside of the base plate 31, a pair of downwardly projected lugs 38, 38 are provided which are transversely spaced apart from each other. The lugs 38, 38 are formed with engagement holes 39, 39, respectively. For the transfer of pallet 30 from one process position to a subsequent process position, the engagement part 35 is clamped by catches 26, 26 of the transfer device 20, the pallet 30 is first lifted up together with workpieces W and then rolled to the subsequent process position, where it is lowered down and released from the catches 26, 26, to be set in a predetermined working position.

The impregnation process of the system 50 includes first, at the initial charging station a, charging a pallet 30 with workpieces W held thereto, moving the charged pallet 30 to the next station b which is an impregnating station, and setting the pallet 30 together with the workpieces W into an impregnation device 1.

Figure 3:
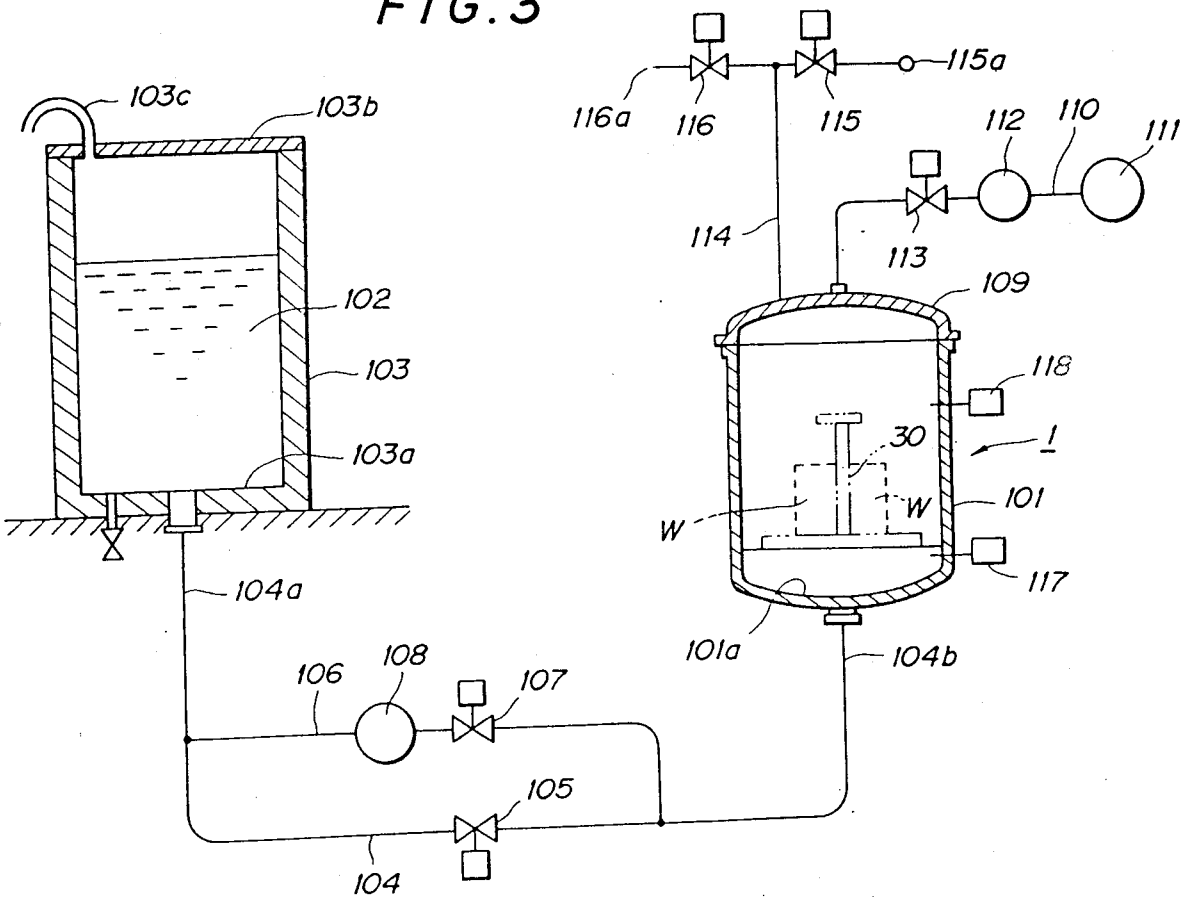
FIG. 3 is a schematic representation showing the constitution of an impregnation device in the impregnation system of FIG. 1.

The impregnation device 1 has the constitution schematically shown in FIG. 3. An impregnation tank 101 is connected through a communication line 104 with a neighboring impregnant tank 103 (unshown in FIG. 1), at the bottom thereof, the tank 103 containing an impregnant 102. A stop valve 105 is installed in the communication line 104. The stop valve 105 includes a solenoid valve. Between a predetermined point in a section 104*a* of the line 104 lying at the upstream side of the valve 105 or at the side of the impregnant tank 103 and another predetermined point in a section 104*b* thereof at the downstream side of the valve 105 or at the side of the impregnation tank 101, there is provided a bypass line 106, which includes a stop valve 107 and a return pump 108 installed upstream of the valve 107. The impregnation and the impregnant tanks 101, 103 have a level difference relative to each other, such that a bottom part 103*a* of the tank 103 is placed at a higher level than a bottom part 101*a* of the tank 101. Though being covered with a lid member 103*b*, the interior of the impregnant tank 103 communicates with the atmosphere.

The impregnation tank 101 is covered at the top thereof with an openable lid 109, which is adapted for liquid- and air-tight sealing. The tank 101 is connected, through a suction line 110 lead out therefrom at a point on the top lid 109, to a vacuum pump 111 for evacuating air from the sealed tank 101. The interior of the tank 101 is also selectively communicatable, through a lead-in/vent line 114 and either of stop valves 115, 116 with a high-pressure air source 115*a* or a vent line 116*a* opening to atmosphere. The suction line 110 is provided with a filter 112 and a stop valve 113.

When performing impregnation in the impregnation device 1, the top lid 109 is opened. The pallet 30 with workpieces W held thereto is lowered into the impregnation tank 101 and is set therein by the transfer device 20. The lid 109 is closed. The valves 105, 107, 115, 116 are closed and the valve 113 opened while the vacuum pump 111 is operated thereby evacuating air from the tank 101 as well as from the holes in the workpieces W. The valve 113 in the suction line 110 to the vacuum pump 111 is closed. Then, at the upstream side as the impregnant tank 103 side of the impregnation tank 101, while leaving the valve 106 of the bypass line 106 closed, the valve 105 of the communication line 104 is opened, permitting the impregnant 102 to flow from the tank 103 into the tank 101 by vacuum of the latter or the pressure difference therebetween. Since the bottom part 103*a* of the impregnant tank 103 is placed higher than the bottom part 101*a* of the impregnation tank 101, the flow of the impregnant 102 is effectively and quickly made.

The impregnant level of the impregnation tank 101 is checked by a pair of level switches 117, 118. When the tank 101 is filled with the impregnant up to a predetermined height, the valve 105 of the communication line 104 is closed. Subsequently, the valve 115 of a high-pressure air line is opened to introduce high-pressure or compressed air from the high-pressure air source through the line 114 into the tank 101, to thereby pressurize the impregnant in the tank 101, forcibly filling in pores such as blowholes and pinholes in the workpieces W with the impregnant. During this impregnation, also recesses or holes such as oil paths, blind holes, and tap in holes bored in the workpieces during the antecedent machining processes are filled with the impregnant.

After such impregnant filling of pores of the workpieces W by use of high-pressure air, the high-pressure air valve 115 is closed and, subsequently, the atmosphere valve 116 is opened to thereby reduce the inner pressure of the impregnation tank 101 to the same pressure as the atmosphere. Then, at the impregnant tank 103 side of the tank 101, the valve 107 of the bypass line valve 106 is opened and the return pump 108 is operated to thereby forcibly return the entire amount of the impregnant from the tank 101 through the line 106 to the tank 103. Thereafter, the bypass valve 107 is closed. Substantially concurrently therewith, the upper lid 109 is opened, and the pallet 30 is lifted out by the transfer device 20, to take out the workpieces W from the tank 101 before sending to the next station c which is a shakeoff station.

Incidentially, in the impregnation process at the station b, it is permitted upon completion of impregnation to immediately transfer the workpieces W to a subsequent process, thus greatly decreasing the time of impregnation process.

More particularly, upon completion of impregnation, the impregnant is forcibly returned by the return pump 108 to the impregnant tank 103, thus permitting the liquid return to be quickly made. Since the return of the liquid is performable while the top lid 109 of the impregnation tank 101 is open, the workpieces W can be taken out from the tank 101 even during liquid return. Accordingly, the cycle time of process including detachment and attachment of workpieces W into and out of the tank 101 can be shortened, with possible increase in the productivity.

Further, for the flow of impregnant from the impregnant tank 103 to the impregnation tank 101 which inherently depends on the pressure difference therebetween, there is intentionally provided a level difference therebetween, thereby achieving quick and effective transfer of the impregnant from the tank 103 to the tank 101.

As shown in FIG. 1, the shakeoff station c is installed subsequent and close to the impregnation station b. The shakeoff station c includes a shakeoff device 1 comprising an upwardly opened shakeoff tank 203 supported on a shaft 202 rotatably disposed between a front and a rear base frames 201, 201. At the station c when performing the process of shakeoff, the transfer device 20 sets the pallet 30 holding the workpieces on a holding table 204 in the shakeoff tank 203. Axle 208 of the table 204 is driven to rotate by a drive mechanism installed outside of the bottom part of the tank 203. The drive mechanism comprises a motor 205, a chain and sprocket transmission 206, and a reduction gearing 207. By operating the motor 205 under such condition, the workpieces W held on the pallet 30 on the table 204 are caused to rotate about the axis of the axle 208, so that excessive impregnant adhering to the workpieces W is shaken off to be separated therefrom by centrifugal forces.

At the shakeoff station c, after such shakeoff process, the pallet 30 is lifted by the transfer device 20, to be thereby sent to the next station d as a first washing station.

As shown in FIGS. 4 and 5, in the first washing station d, there is installed a washing device 3 comprising an upwardly opened washing tank 301 which is substantially rectangular at its base. The tank 301 has a pair of inwardly projecting pivot shafts 303, 304 opposing to each other at the vertically middle parts of transversely opposed walls 302, 302 thereof. The pivot shafts 303, 304 are fastened from outside to the upper parts of right and left arms **305*a*, 305*b* of a work-holding frame 305 of a channel-form in front view which is thereby suspended on the tank 301. The holding frame 305 has a bottom frame 305*c* provided with a pair of support rods 306, 306 standing thereon. A front member 305*d* of the bottom frame 305*c* has a right and a left cut-outs 307, 307 formed therein. A transversely slidable lock rod 308 is provided at the front side of the front member 305*d* extending therealong, for locking the pallet 30 on the holding frame 305. The rod 308 has a pair of elongate holes 309, 309 engaged with a pair of pins 310, 310 projecting from the front member 305*d*, whereby it is permitted to slide transversely, and is normally biased in the pallet-locking direction thereof or to the left in FIG. 4 with a transversely arranged spring 311 fastened at opposite ends to the bottom frame 305*c* and the lock rod 308. Further, the rod 308 is provided with a right and a left lock pin portions 312, 312 formed thereon. A push rod 313 is provided through one of the walls 302 at a predetermined level to engage the rod 308 and push it in the pallet-unlocking direction. A linkage 314 for pushing to actuate the push rod 313, with a rod 316 of a drive cylinder 315 is provided outside of the tank 301. Either of the pivot shafts 303, 304 supporting the holding frame 305 of such constitution is driven by a motor 317 installed outside of the walls 302**, through a reduction gearing (not shown) interposed therebetween.

When washing workpieces W in the first washing station d, the washing tank 301 is filled with a washing liquid 318, such as water, up to a level substantially the same as the left and the right pivot shafts 303, 304 therein, as shown in FIG. 5, in order to wholly submerge the workpieces W in the washing liquid 318 when they are set into the tank.

Further, in order to position the workpieces W in the position as shown in FIG. 5, the pallet 30 with the workpieces fixed thereon is moved to the first washing station d, to a position above the washing tank 301 and lowered. From a state as shown in FIG. 4, the slide rod 23 of the lifting cylinder 22 is further extended to enable the support rods 306, 306 to engage pallet 30. Concurrently, the lugs 38, 38 at the bottom of the pallet 30 engage with the cut-outs 307, 307 of the holding frame 305, thereby setting the pallet 30 on the bottom frame **305*c*. The cylinder 315 is then operated to retract the rod 316 thereof, thereby causing, through the linkage 314, the push rod 313 to move leftwardly in the Figure. The spring 311 biases the lock rod 308 to move leftwardly in the Figure, causing the pin portions 312, 312 of the lock rod 308 to engage with the engagement holes 39, 39 of the lugs 38, 38 of the pallet 30. Such engaging movement is quickly accomplished due to the force of the spring 311**.

Thereafter, by operating the cylinder 27, the engagement part 35 of the pallet 30 is released from the catches 26, 26, and the holding mechanism consisting of the elements 24, 25, 26, 26, 28 of the transfer device 20 is lifted out of the way by the cylinder 22, resulting in the state as shown in FIG. 5. The pallet 30 holding the workpieces W in such state is locked and held by the holding frame 35 in the tank 301.

Then, by operating the motor 317 at the side of the washing tank 301, the holding frame 305 and hence the workpieces W rotate together with the pallet 30, about the axis of the pivot shafts 303, 304, inside of the washing liquid 318 as a matter of course and along due course to above the surface thereof.

FIGS. 6A to 6H are stepwise illustrations showing such rotation of the holding frame 305 and hence of the workpieces W. In this respect, those Figures are given as schematic, partial sectional views taken along line VI—VI of FIG. 2. The two workpieces W are represented by only one of them, the other being ommitted. Likewise, the holding frame 305 is represented by nothing but the left arm **305*b***.

Figures 6A, 6B, 6C, 6D, 6E, 6F, 6G, 6H:
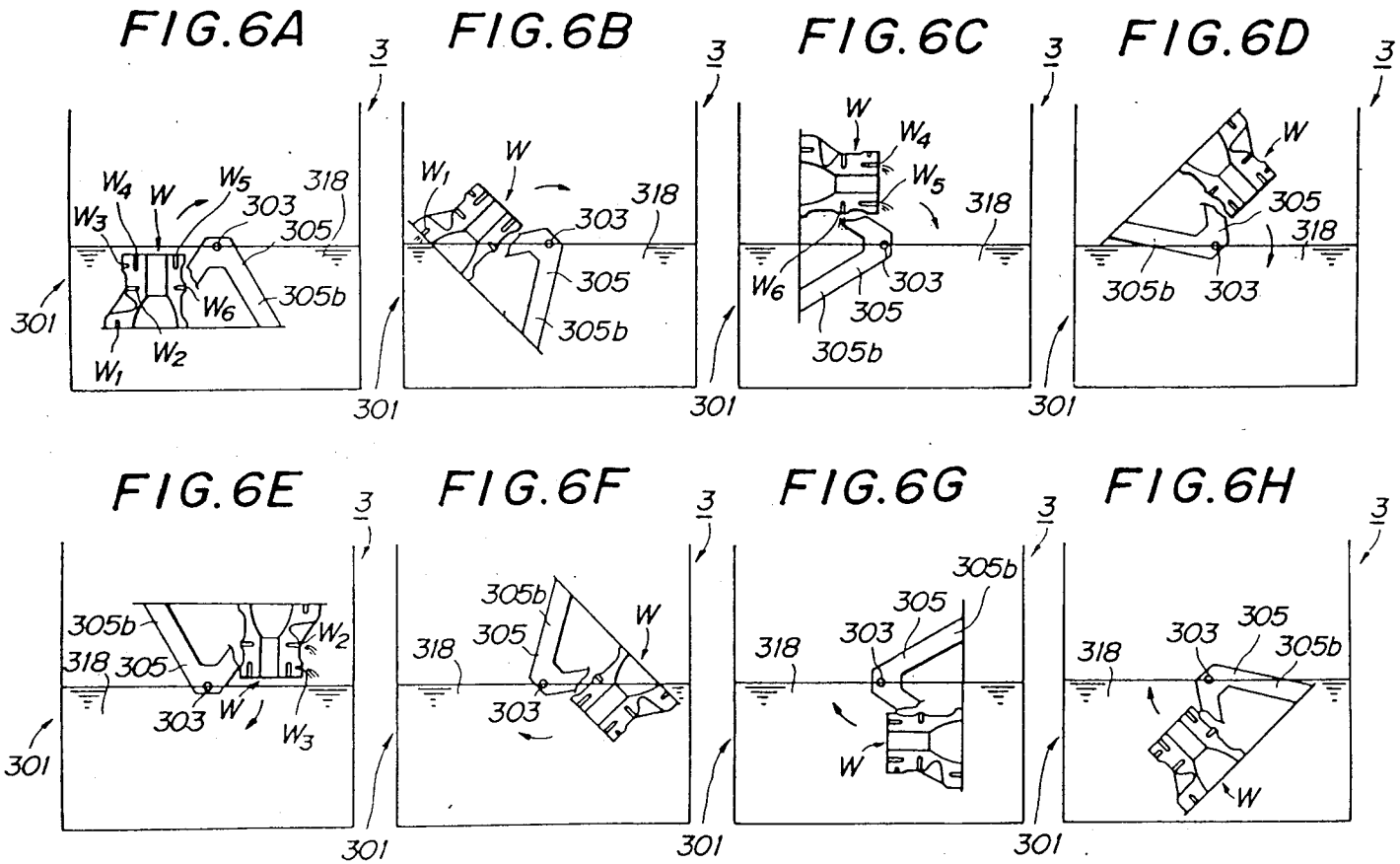
FIGS. 6A to 6H are illustration stepwise describing those washing operations of workpieces to be made by the washing device.

FIG. 6A shows an initial state of rotation in which the workpiece W is entirely submerged in the washing liquid 318. Residual impregnant is adhering to recesses or concavities $W_1$ to $W_6$ such as tap holes, blind holes, oil paths, and water jacket paths of the workpiece W, while there is also intrusion of washing liquid due to submergence. The workpiece W initially is rotated in the washing liquid 318 in a substantially continuous manner, with the holding frame 305 driven by the motor 317, clockwise or in the direction of arrow of FIGS. 6A to 6H.

FIG. 6B shows a state in which more than half of the workpiece W is exposed above the surface of the washing liquid 318. At the recess $W_1$, the impregnant is being discharged together with the washing liquid.

FIG. 6C shows a state having rotated at 90° from the state of FIG. 6A, in which the workpiece W is exposed above the liquid surface and is horizontally oriented. At the recesses $W_4$, $W_5$, and $W_6$, the excess impregnant is discharged together with the washing liquid.

The workpiece W is further rotated, through a position as shown in FIG. 6D, to a position as in FIG. 6E, where it has been rotated at 180° from the state of FIG. 6A and the impregnant from the remaining recesses $W_2$, $W_3$ is discharged together with the washing liquid.

As the rotation is continued, the workpiece W is again submerged in the washing liquid, as shown in FIGS. 6F and 6G. In such state, the previously drained recesses $W_1$ to $W_6$ once again have washing liquid entering therein.

The workpiece W and hence the holding frame 305 is further continuously rotated, sequentially repeating the respective states of FIGS. 6A to 6H.

After having been rotated through a predetermined number of revolutions, the holding frame 305 is rotated in the reverse direction, that is, counterclockwise in FIGS. 6A to 6H through a predetermined number of revolution, whereby the washing liquid has been forced to go in and out of the recesses $W_1$ to $W_6$ a number of times, thus effectively diluting any residual impregnant in such recesses, and finally washing away the impregnant in all of the recesses $W_1$ to $W_6$.

At the first washing station d, the washing described is made by rotating the workpiece W about an axis of the pivot shafts 303, 304 lying the transverse direction of the system 50.

Then, by use of the transfer device 20, the workpieces W on the pallet 30 are taken out of the washing tank 301 and sent to the station e as a second washing station.

In the second washing station e, there is installed a washing device 4 substantially similar in structure to the washing device 3 of the antecedent station d. More particularly, the washing device 4 includes a pair of shafts 403, 404 for rotating a holding frame 405, provided at the front and the rear of a washing tank 401, respectively, and extending in the longitudinal direction of the system 50 in FIG. 1. A motor 417 for rotating the holding frame 405 is disposed at the front side thereof in FIG. 1, so that the workpieces W held on the holding frame 405 are rotated about an axis 403–404 extending in the longitudinal direction of the system 50. As a result, in the second washing station e, washing is principally made to those recesses of the workpieces W which are oriented 90° out of phase from the aforementioned recesses $W_1$ to $W_6$.

Accordingly, the recesses in the workpieces W are all effectively washed.

After all of the recesses have been washed in the first and the second washing stations d, e, the workpieces W are sent by the transfer device 20 to the station f as a subsequent neighboring shakeoff station. In the shakeoff station f, there is installed a shakeoff device 5 similar in structure to the shakeoff device 5 of the antecedent shakeoff station c. Workpieces W held on pallet 30 are set to be fixed on a holding table 504 in a shakeoff tank 503, and rotated together with the pallet 30 by a motor 505, thereby shaking off residual washing liquid left on the surfaces of the workpieces W.

After having the excess liquid shaken off at the shakeoff station f, workpieces W are sent to the next station g as a workpiece unloading station, from which they are further transferred to subsequent processes (not shown) such as a drying process.

As will be understood from the foregoing description, at the impregnation device 1 in the impregnation station b of the impregnation system 50, the bypass line 106 having the bypass stop valve 107 and the impregnant return pump 108 is provided for the communicatcn line between the impregnant tank 103 and the impregnation tank 101, thereby permitting workpieces W to be soon sent to subsequent processes.

More particularly, upon completion of impregnation, the impregnant is forcibly returned by the return pump 108 to the impregnant tank 103, thus permitting the return of liquid to be quickly made. Further, since the return of the liquid is performable while the top lid 109 of the impregnation tank 101 is opened, workpieces W can be taken out from the tank 101 even during the return of liquid. Accordingly, the cycle time of process including detachment and attachment of workpieces W into and out of the tank 101 can be shortened, with possible increase in productivity.

Further, for the impregnant conduction from the impregnant tank 103 to the impregnation tank 101 that inherently depends on pressure difference therebetween, there is intentionally provided a level difference therebetween, thereby achieving quick and effective transfer of the impregnant from the tank 103 to the tank 101.

Moreover, impregnated workpieces W are completely rotated so as to be immersed in and come out of the washing liquid, thereby diluting residual impregnant in recesses such as tap holes. This causes the residual impregnant to fail to exhibit hardening, permitting effective washing thereof, so that the impregnant is favorably discharged to be removed from the recesses in the workpieces W. Furthermore, the washing of the workpieces W is performed at two washing tanks 301, 401 different by 90° in phase between the axes 303–304, 403–404 of rotation of the workpieces W, thereby permitting complete washing of all of the recesses thereof.

As will be comprehended from the foregoing description, according to the present invention, an impregnated workpiece with impregnant adhering thereto is rotated so as to be submerged in and come out of washing liquid, thereby forcibly causing the washing liquid to go in and out of recesses such as concavities and holes formed in the surface of the workpiece. This thereby dilutes impregnant in the recesses, causing same to fail to exhibit hardening, permitting effective washing thereof. Thus, the impregnant is favorably discharged to be removed, while permitting the removal to be performed in an automatic manner without the need of relying on hand work. This enables effective and firm washing of the work.

Moreover, as an entire impregnation process, a series of process steps such as of impregnation, impregnant shakeoff, washing, and drying can be sequentially performed, thus permitting the entire impregnation process to be automated in accordance with the tactics of good management, effectively elevating the production rate of impregnated goods.

Incidentally, in the embodiment described, the rotation axis 403–404 of the workpieces W in the second washing station e is directed in a direction different by 90° from the rotation axis 303–304 of the workpieces W in the first washing station d. In this respect, however, such rotation axes are not always needed to extend in directions different by 90° from each other. Exemplarily, there may advantageously be employed a modification in which such rotation axes are deviated substantially at 60° from each other. Additional washing stations can be provided.

Moreover, in the embodiment described, by providing two washing stations d, e, the workpieces W are sequentially rotated about the axes 303–304 and 403–404 different by 90° in phase from each other. In this respect, however, the washing of workpieces W by such rotation may advantageously be performed in a single washing station.

Although there has been described what is at present considered to be the preferred embodiment of the invention, it will be understood that the present invention may be embodied in other specific forms without departing from the spirit or essential characteristics thereof. The present embodiment is therefore to be considered in all respects as illustrative and not restrictive. The scope of the invention is indicated by the appended claims rather than by the foregoing description.

We claim:

1. A method for washing an impregnated porous workpiece fixed to a pallet, said workpiece having recessed portions extending in different directions thereinto, comprising the steps of:

shaking off excess impregnant from said impregnated workpiece;

fixing said pallet holding said impregnated porous workpiece on a rotating frame in a washing tank containing a washing liquid;

performing a washing by rotating said frame about a horizontal axis for a plurality of rotations to move said workpiece in such a manner that the workpiece is completely immersed in and comes completely out of said washing liquid during each rotation of said frame, thereby causing said liquid to go in and out of said recessed portions in said workpiece during each rotation to dilute and wash away residual impregnant adhering to the inside of said recessed portions.

2. A washing method according to claim 1, wherein: said workpiece is alternately rotated in different directions of rotation opposite to each other.

3. A washing method according to claim 1, wherein: said workpiece is sequentially rotated in first and second washing steps about at least two horizontal rotation axes extending in different directions from each other, respectively.

4. A washing method according to claim 3, wherein: said first and second washing steps include rotation of said workpiece sequentially about at least two rotation axes extending in directions different substantially by 90° from each other respectively.

5. A method for washing impregnant from an impregnated porous workpiece fixed to a pallet, said workpiece having recesses extending in differenct directions thereinto, comprising the steps of:

providing first and second rotating frames in first and second washing tanks;

fixing said pallet to said first rotating frame of said first washing tank containing a washing liquid and rotating said frame in a first washing step so as to turn said pallet about a first horizontal axis to move said workpiece to be repeatedly immersed into and withdrawn out of said washing liquid during each rotation, each rotation of said first frame and workpiece causing washing liquid to enter and be discharged from recesses in said workpiece, said first washing step incompletely washing impregnant from recesses extending in some directions; and removing said pallet from said first rotating frame and fixing said pallet to said second rotating frame of said second washing tank containing a washing liquid and rotating said frame in a second washing step so as to turn said pallet about a second horizontal axis transverse to said first axis to move said workpiece about said second axis to be repeatedly immersed into and withdrawn out of said washing liquid during each rotation, each rotation of said second frame and workpiece causing said liquid to enter and be discharged from recesses in said workpiece including those incompletely washed in said first washing step;

such that rotation of said workpiece about said first and second axis causes washing liquid to wash away residual impregnant in all recesses of said workpiece.

* * * * *